US005438903A

United States Patent [19]

Cropek

[11] Patent Number: 5,438,903

[45] Date of Patent: Aug. 8, 1995

[54] REMOTELY-OPERABLE HIGH-HAT SPEED CLUTCH

[76] Inventor: William S. Cropek, 2440A Curry Cir., N., Holoman A.F.B., N. Mex. 88330

[21] Appl. No.: 79,170

[22] Filed: Jun. 21, 1993

[51] Int. Cl.[6] ..... G10D 13/02

[52] U.S. Cl. ..... 84/422.3

[58] Field of Search ..... 84/422.3

[56] References Cited

U.S. PATENT DOCUMENTS 4,488,471 12/1984 Youakim ..... 84/422.3

4,928,567 5/1990 Kurosaki ..... 84/422.3

*Primary Examiner*—Michael L. Gellner

*Assistant Examiner*—Patrick J. Stanzione

*Attorney, Agent, or Firm*—Donald R. Boys

[57] ABSTRACT

A high-hat cymbal unit has a remotely-operable speed clutch actuated by operation of a base drum foot pedal assembly to allow the upper cymbal to drop into contact with the lower cymbal without operating the high-hat foot pedal or striking the speed clutch with a drum stick. In one embodiment the speed clutch is operated by a sheathed cable connected to the base drum foot pedal, and in another the base drum foot pedal has an electrical switch closed by operation of the foot pedal signaling a solenoid unit on the high-hat to operate the speed clutch.

11 Claims, 7 Drawing Sheets

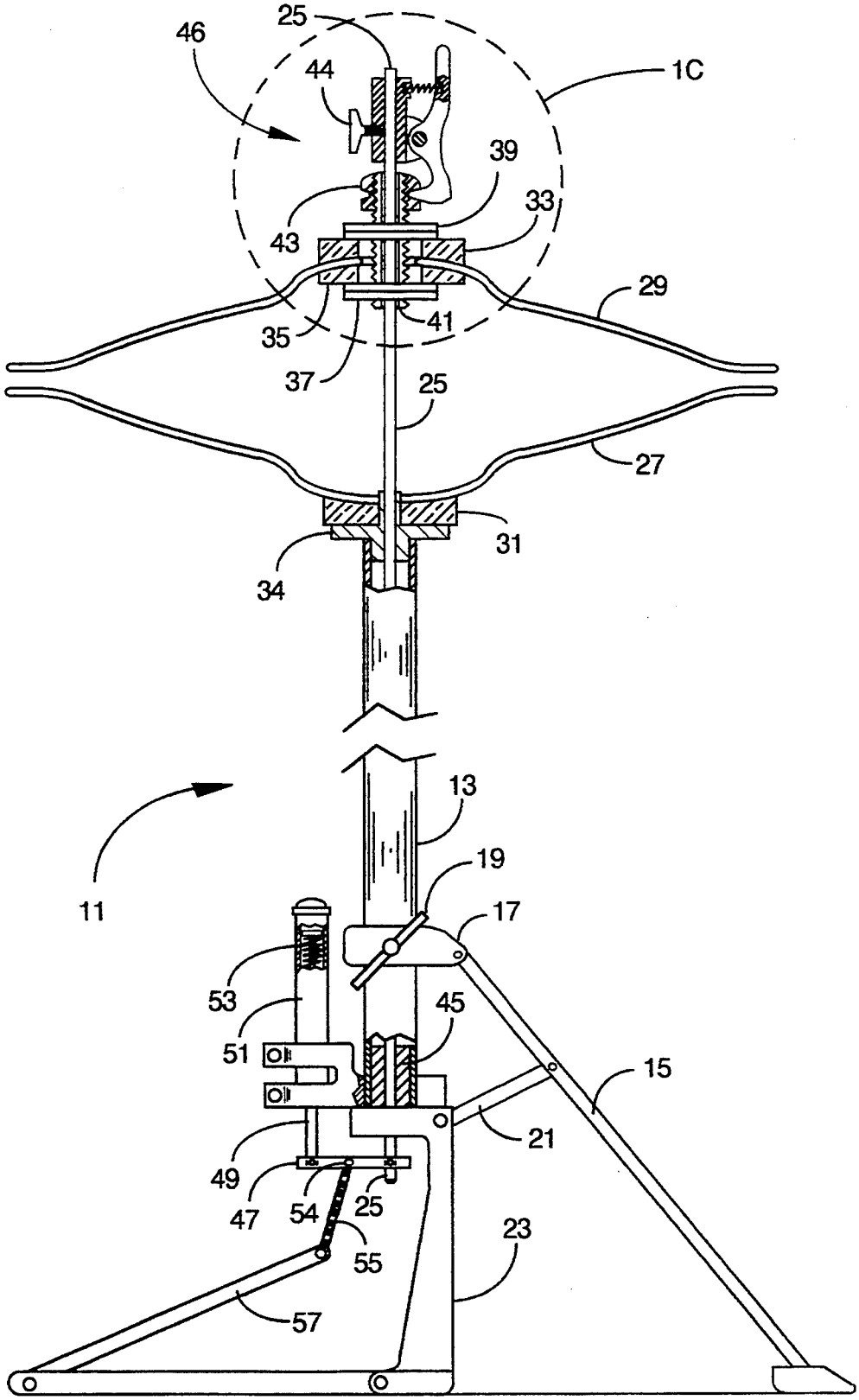
46
25
44
1C
39
33
43
29
35
41
37
25
27
31
34
13
11
19
17
53
45
51
15
21
49
47
54
25
23
55
57

REMOTELY-OPERABLE HIGH-HAT SPEED CLUTCH

FIELD OF THE INVENTION

The present invention is in the broad area of percussion instruments in the musical arts, and pertains more specifically to high-hat cymbal apparatus and methods for operating same.

BACKGROUND OF THE INVENTION

Percussion instruments in the musical arts are among the oldest instruments known, having origins in hollowed logs played with sticks. Drums, bells, cymbals, and the like have been manufactured and played in almost every culture and form a part of all known sorts of organized music.

Drum sets, popularly known as kits by the musicians who play them, have advanced in the art considerably since the advent of rock music in the 1950's, and have taken on perhaps a more central roll in later forms of rock, such as the music forms known as hard rock, acid rock, and "heavy metal". Perhaps the essential reason for the enhanced importance of percussion instruments in these music forms is an underlying component element of heavy rhythm.

Drummers are, like most musicians, very individualistic, and motivated at all times toward innovation both in equipment and style. Moreover, a drummer's "instrument" is more correctly a group of instruments, more so than with most other musicians. A modern kit includes at least one base drum played with a foot pedal, various sorts of bells and cymbals, several other sorts of drums on stands, such as snare drums, and more. Different drummers use different components, and arrange the components quite differently.

Even with all the variation in kits and components, however, there are many commonalities. Almost all kits have at least one base drum, and most kits include a cymbal set called a high-hat. It is with base drums and high-hats that the present invention is principally concerned.

Base drums are typically cylindrical bodies held in a stand with cylindrical axis horizontal, having drum heads at each end, and played by a pivoted striker attached to the stand and operated by a foot pedal. A high-hat is a cymbal set having two opposed cymbals oriented substantially horizontally and normally spaced apart by a short distance (an inch or so). The lower cymbal of the two-cymbal set is typically suspended in a felt-padded clamping device firmly attached to a stationary hollow vertical shaft. This lower cymbal does not normally change position.

The upper cymbal of the two-cymbal set of a high-hat is typically suspended in a felt-padded clamping device attached to a rod passing up through the stationary hollow vertical shaft and guided in linear bearing guides in the hollow shaft. The rod carrying the upper cymbal is operable by a spring-biased foot pedal similar to the foot pedal provided for a base drum striker. The position of the upper cymbal on the central rod is typically adjustable in a high-hat.

A drummer in some instances may strike the upper cymbal with a drum stick with the high-hat "open", in which case the sound is that of a felt-suspended cymbal struck. The drummer may create another rhythmic effect by bringing the cymbals together by depressing the foot-pedal. To borrow an electrical engineering term, the high-hat is "normally open", and is closed by depressing the foot pedal. When a drummer moves his foot from the foot pedal (releases the pedal), the spring bias of the foot pedal, applied to the central rod upon which the upper cymbal is mounted, opens the high-hat.

A drummer in some instances strikes the high-hat upper cymbal with the high-hat closed, and there are many, many variations in rhythm and sound which a drummer may produce by varying the foot pressure and timing of operation in opening and closing the high-hat, the relative open position of the cymbals, the stick or brush used to strike, the position and force of the strike, the variations in timing of strikes, the interweaving of strikes on the high-hat with effects produced on other apparatus in the kit, and more.

In later and more volumetric forms of rock, such as heavy metal rock, drummers often incorporate two base drum units into a single kit. This is termed "double-base". Double base enhances the base beat and makes it possible to provide more varied and interesting base beats. Also, in these double-base kits, high-hats are still used to produce essentially the same sounds and effects that high-hats are known to produce. There is a problem, however. Each base unit has a foot pedal, the high-hat has a foot pedal, and most drummers have but two feet.

With a three-foot-pedal kit, there are invariably times that a drummer wants to be "on" the double base, and at the same time to strike the high-hat cymbal set "closed". With the original form of high-hat apparatus this could not be done. Accordingly, a high-hat speed clutch was developed, wherein the upper cymbal of the high-hat is carried in a tandem unit.

The clutch portion of the tandem unit is firmly fastened to the central operating rod, and includes a spring-biased pivoted operating lever for carrying a suspension member that in turn carries the upper cymbal of the high-hat. The pivoted lever engages a downward-facing shoulder of the suspension member, and with the clutch engaged, the high-hat operates in the conventional way, that is, when the drummer operates the foot lever, the cymbals are brought together.

With the speed clutch, when one goes on the double base, necessarily releasing the high-hat foot lever, the high-hat opens, as is conventional. The drummer, however, has the option of striking the spring-biased operating lever of the speed clutch with a sideward stroke, which disengages the lever from the downward-facing shoulder, and allows the suspension member, carrying the upper cymbal, to fall. The upper cymbal drops on the lower cymbal, and the spring-biased operating lever then presses on a sloped cam surface of the suspension member, urging the cymbals of the high-hat together. The drummer can now operate the double base, one with each foot, and also strike the closed high-hat cymbals, biased closed by the spring-cam feature of the speed clutch.

To open the high-hat again, the drummer shifts one foot to the high-hat foot pedal, and depresses the pedal fully. This causes the spring-biased operating lever of the speed clutch to ride over the cam portion of the suspension member, re-engaging the downward-facing shoulder. Then when the foot pedal is released again, the central rod raises, carrying the upper cymbal along by virtue of the engaged speed clutch. The high-hat can now be operated again in the conventional way.

The design and operation of the conventional speed clutch will be made more apparent by drawings and further description below in the description of various embodiments of the present invention.

The conventional speed clutch, while making it possible to use the double base, and at the same time to strike a closed high-hat, still has serious drawbacks and limitations. One is that the spring-biased operating lever is a relatively small target, and, depending on other immediate demands, the drummer may not be able to look at the speed clutch and carefully aim a sideward stroke to disengage the clutch. As a result, there is a high incidence of misses in striking the operating lever of the speed clutch. When one misses, the continuity of playing is interrupted, and one or more additional strokes have to be used to operate the speed clutch.

Another problem is that a stroke has to be used at all. The stroke to operate the speed clutch is not a musical stroke, and has no function in "licks" a drummer creates. It is an unwelcome sound as well.

What is needed is a reliable, no-miss means of operating the speed clutch at the right time, that is, when the drummer goes on the double base, without a stick stroke. Such an apparatus would allow the drummer to use the time formerly used for striking the operating lever for striking another musical element, enhancing the play. Such an apparatus would also eliminate the unwanted sound of striking the speed clutch operating lever.

SUMMARY OF THE INVENTION

In a preferred embodiment of the invention, a remotely-operable high-hat speed clutch for use with a high-hat cymbal apparatus having a vertically-movable central shaft operated by a foot pedal is provided having a clamp cylinder means adjustably mountable on the vertically-movable central shaft for supporting the speed clutch on said central shaft. There is an upper cymbal carrier means slidably engaging the vertically-movable central shaft for carrying an upper cymbal of a two-cymbal set of the high-hat cymbal apparatus, and a coupling means attached to one of the clamp cylinder means and the upper cymbal carrier means and engaging the other of the clamp cylinder means and the upper cymbal carrier means such that while engaged both travel vertically with the central shaft. There is additionally a remotely-operable disengagement means for disengaging the coupling means to allow the upper cymbal carrier means to slide on the vertically-movable central shaft.

In a specific embodiment the coupling means comprises a lever pivoted on the clamp cylinder means and engaging an indenture on the upper cymbal carrier means and the remotely operable disengagement means comprises operating means for rotating the lever to disengage the indenture. In various embodiments the lever is rotated by an operating cable from a base drum foot pedal, or by a solenoid assembly operated by a switch closed when the base drum foot pedal is operated.

By operating the speed clutch from the base drum foot pedal it is no longer necessary to strike the operating lever of the speed clutch with a drum stick or other striker when switching the foot that normally operates the high-hat to the base drum foot pedal. A stick stroke, and the time to make it, is saved, allowing more flexibility in playing the drum set.

BRIEF DESCRIPTION OF THE DRAWINGS

FIG. 1A is an elevation view of a conventional high-hat cymbal unit with a speed clutch, partially cut-away to reveal operative details.

DESCRIPTION OF THE PREFERRED EMBODIMENT

Figure 1B:
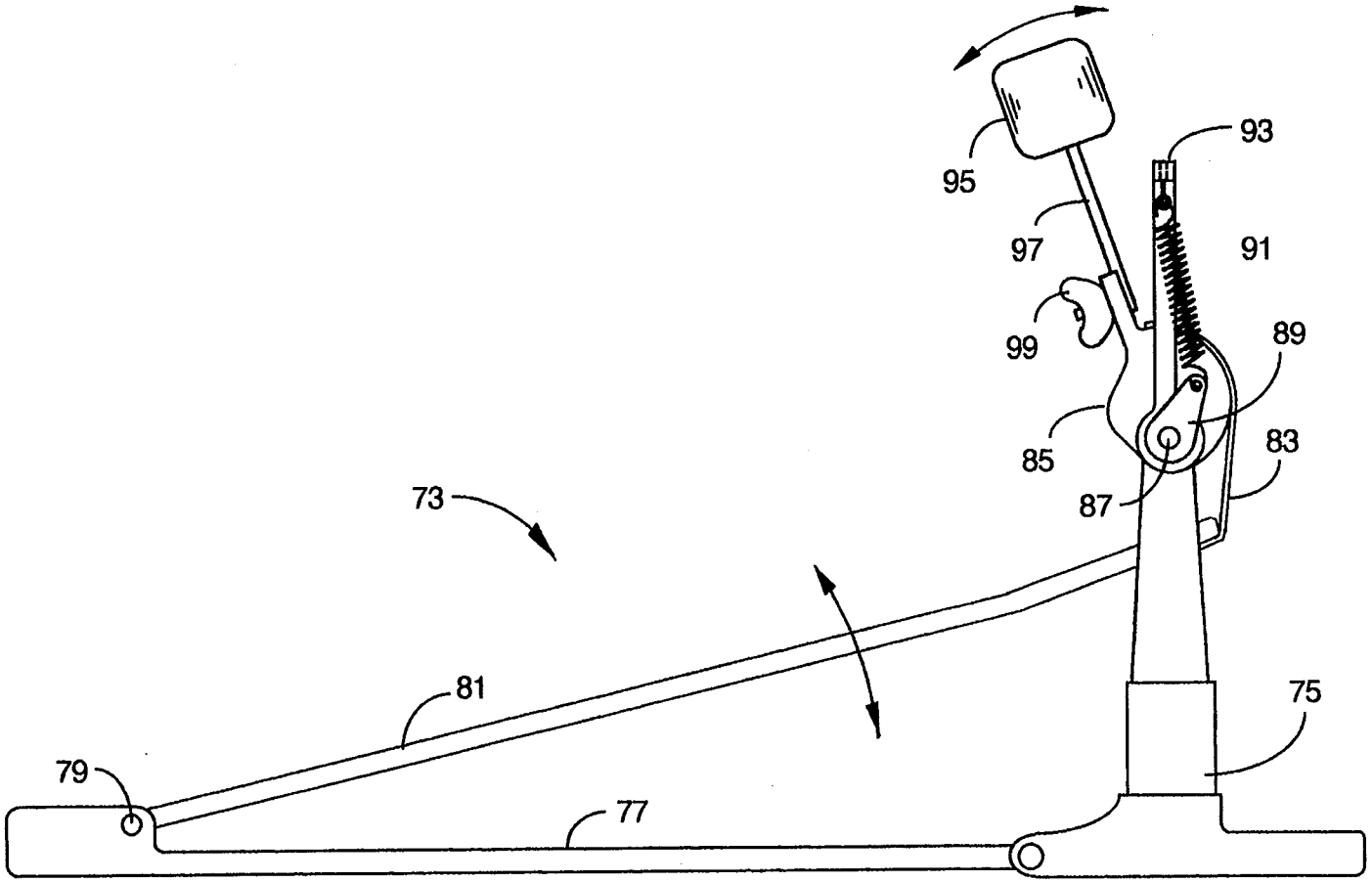
Fig. 1B Prior Art
FIG. 1B is an elevation view of a base drum foot pedal and striker unit.

FIG. 1A is an elevation view of a conventional high-hat cymbal unit 11 with a speed clutch, partially cut-away to reveal operative details. This particular high-hat unit is based on a unit made by Tama in Aichi, Japan, except some liberty has been taken in detail to simplify the drawing and the detail of the speed clutch. The purpose is to illustrate the function of the high-hat unit and its component elements.

In this unit a tubular supportive frame 13 is supported by three folding legs. One such leg 15 is shown, and two have been omitted to better illustrate other details. The legs engage pivotal connections in a clamping unit 17 which slidably engages tubular frame 13. A clamping screw 19 serves to secure the clamping unit to the tubular frame when the legs are extended. Also, each leg, such as leg 15 shown, has a pivotal link such as link 21, connecting the leg to a foot-pedal structure 23. In FIG. 1A tubular frame 13 is shown broken lengthwise to allow more detail to be shown in the Figure. There is typically also a slide device to allow the height of the overall unit to be adjusted, but this conventional mechanism is not shown.

The high-hat unit has opposed cymbals 27 and 29 at the upper end, the lower cymbal 27 supported by tubular frame 13 on a felt cushion 31 in turn supported on a bearing insert 34 engaged in tubular frame 13. Upper cymbal 29 is supported between felt cushions 33 and 35 held between lock-nut pairs 37 and 39 on a threaded collar 41, which in turn engages in a threaded hole in a cam cylinder 43. Cam cylinder 43 is part of a speed clutch unit 46 which clamps to shaft 25 by means of a clamp screw 44 such that upper cymbal 29 may be raised and lowered by raising and lowering shaft 25.

Speed clutch 46 is described in further detail below with reference to FIGS. 1C–1D.

Still referring to FIG. 1A, shaft 25 passes down through the high-hat unit through bearing insert 34, which is held in the end of tubular frame 13 and serves as an upper guide for the movable shaft. At the lower end of the tubular frame, shaft 25 passes through another bearing insert 45 which serves as a lower guide for the shaft. Shaft 25 passes through a hole in foot-pedal structure 23 and is securely pinned in a cross-piece 47, which is also securely pinned to a second shaft 49. Shaft 49 extends upward through a tubular spring housing 51 to engage the upper end of a compression spring 53, such that shaft 49, hence shaft 25, and upper cymbal 29 suspended on shaft 25, are normally urged upward, to the limit that spring 53 may extend in housing 51.

The normal (spring extended) spacing between the two cymbals of the high-hat may be adjusted by loosening clamp screw 44, sliding speed clutch unit 46 up or down on shaft 25, and retightening clamp screw 44.

Cross-piece 47 has a pivot connection 54 engaging a short piece of bicycle-type chain 55 which is fastened at the other end to a pivoted foot pedal 57, such that a user may depress the foot pedal to operate shaft 25 and bring the cymbals together.

In one mode of conventional operation, the drummer provides a rhythm by alternately bringing the cymbals together and separating them again by means of depressing and releasing foot pedal 57. Rhythms are also provided by striking the cymbals while open or closed with one or more drum sticks, brushes, or other strikers.

FIG. 1B is an elevation view of a conventional base drum foot pedal unit 73. A frame pedestal 75 has a floor extension 77 with a pivot 79 for a foot pedal 81, A canvas strap 83 attaches to the underside of the foot pedal a wraps partially around and is fastened to an actuator drum 85. The actuator drum is fixed to a shaft 87 pivotally mounted through pedestal 75, such that downward movement of foot pedal 81, through the action of strap 83 causes drum 85 to rotate around the centerline of shaft 87. A spring arm 89 is also fixedly attached to shaft 87 and retains one end of a spring 91 that attaches at the other end to an extension 93 of frame 75.

A striker 95 is mounted on a striker arm 97 mounted in turn to drum 85 by a thumb screw 99. As a drummer bears down on foot pedal 81, the strap causes drum 85 to rotate against spring 91 moving striker 95 to strike the base drum head (not shown). When the drummer releases the foot pedal, spring 91 causes the striker to recede from the drum head.

Figure 1C:
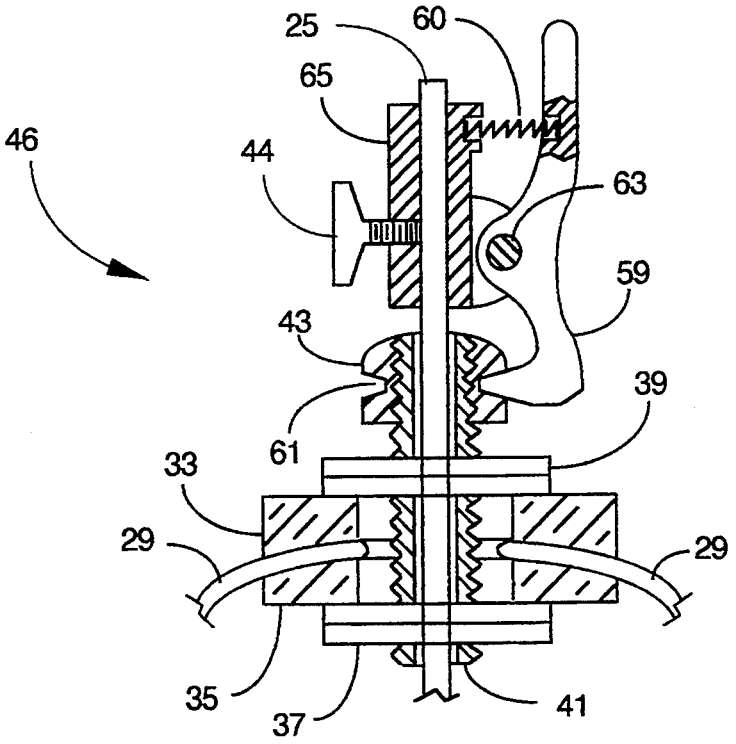
Fig. 1C Prior Art
FIG. 1C is an enlarged view of the speed clutch and associated elements in area 1C of FIG. 1A.

FIG. 1C is an enlarged view of the speed clutch elements in area 1C of FIG. 1A. Cymbal 29, held in cushions 33 and 35 by lock nut pairs 37 and 39 engaging threaded collar 41, are held suspended from cam cylinder 43 also engaged on threaded collar 43, which is suspended in turn by spring-loaded lever 59, urged by a compression spring 60, engaging a matching circumferential groove (indenture) 61 around cam cylinder 43. Lever 59 pivots at pivot 63 which is attached to a clamp element 65 held firmly to shaft 25 by clamp screw 44.

As shown in FIG. 1A and 1C, with lever 59 engaged in groove 61 urged by spring 60, the high-hat operates just as though cam cylinder 43 were affixed to shaft 25, which is the conventional way high-hat upper cymbals are arranged in the art without the use of a speed clutch. Upper cymbal 29 is lowered into contact with lower cymbal 27 by depressing foot pedal 57, and separates from lower cymbal 27 (raises) by virtue of spring 53 raising shaft 25 when the foot pedal is released.

Figure 1D:
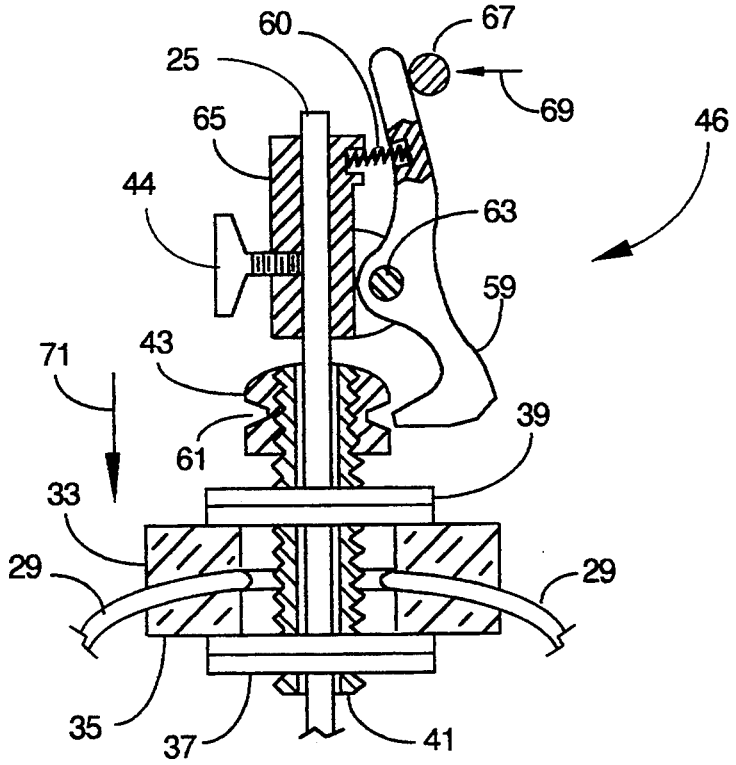
Fig. 1D Prior Art
FIG. 1D is a view of the speed clutch of FIG. 1C struck with a drum stick to release the clutch.

FIG. 1D shows the operation of speed clutch 46 when a drummer switches one of his feet from the high-hat foot pedal to the second foot pedal of the double base. In this conventional case, the drummer strikes lever 59 with a striker, usually a drumstick, such as drumstick 67, in the direction of arrow 69. The strike disengages lever 59 from groove 61 by depressing spring 60, and allows the assembly carrying upper cymbal 29 (comprising threaded collar 41, lock nut pairs 37 and 39, felt cushions 33 and 35, and cam cylinder 43) to fall (in the direction of arrow 71). Upper cymbal 29 falls onto lower cymbal 27.

Figure 1E:
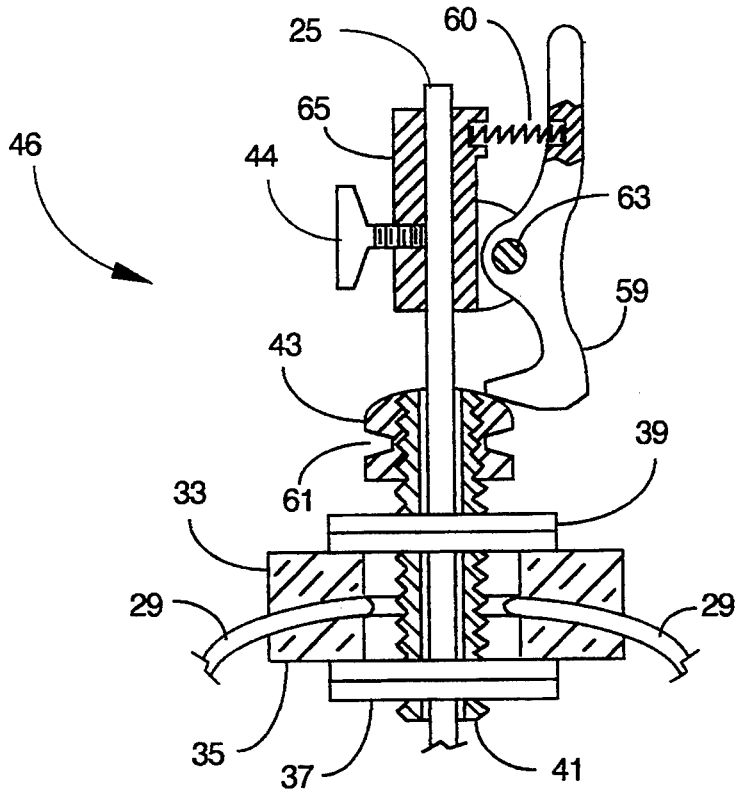
Fig. 1E Prior Art
FIG. 1E is a view of the speed clutch of FIGS. 1C and 1D after the clutch is released.

FIG. 1E shows the case after the strike illustrated in FIG. 1D. Spring 60 extends again, closing lever 59, but the lower assembly having fallen to bring the cymbals together, groove 61 is not in position for the lever to re-engage. Instead, an angled land of the lever bears on the upper face of cam cylinder 43, urging the cymbals together much as they are urged together when the drummer normally operates high-hat foot pedal 57 (FIG. 1A).

As was described in the background section, the problem with the conventional operation described here is that the strike requires an intentional stroke, the target is rather small, and the drummer might miss.

Figure 2A:
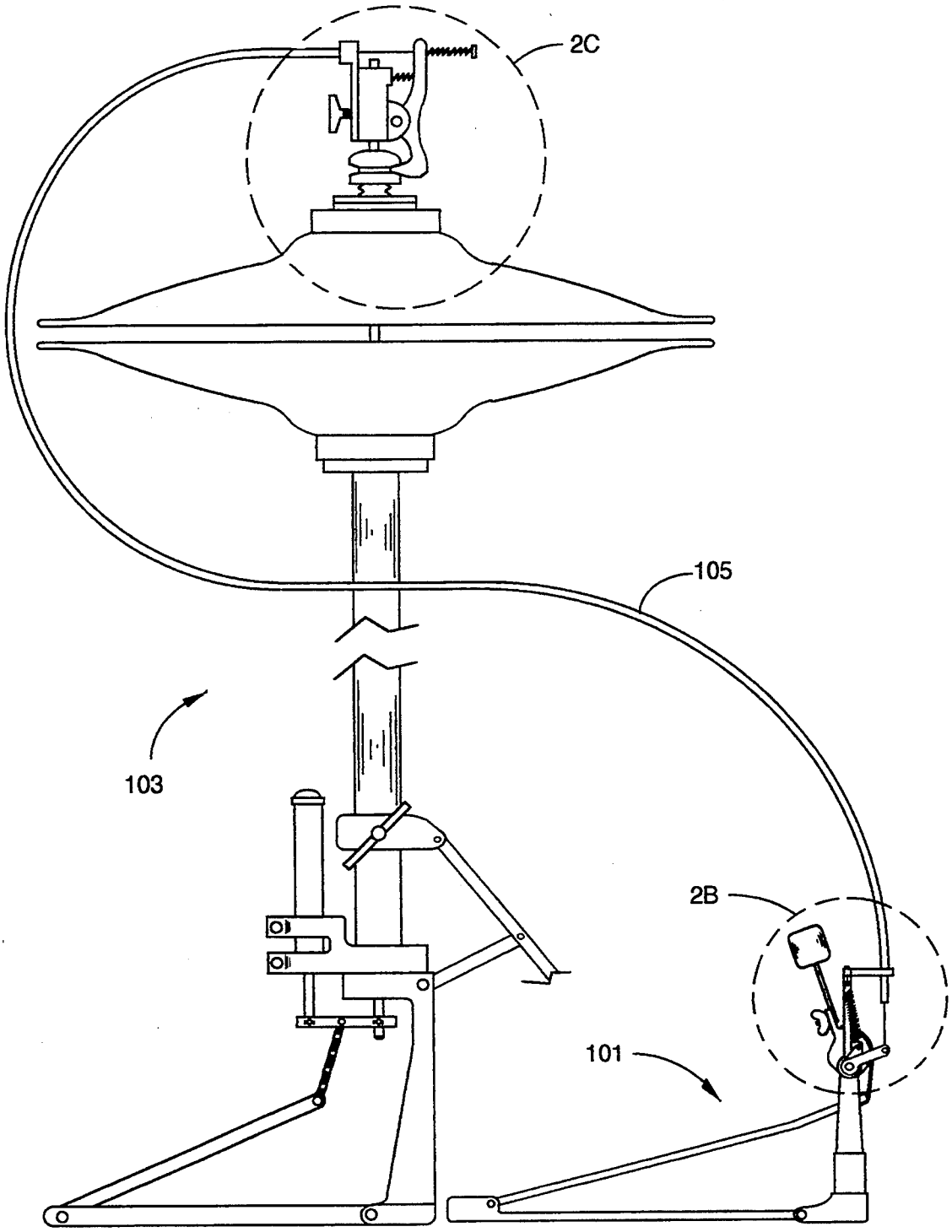
FIG. 2A is an elevation view of a base drum foot pedal unit connected to a high-hat unit by an operating cable according to an embodiment of the present invention.

FIG. 2A is an elevation view of a base drum foot pedal unit 101 connected to a high-hat unit 103 by an operating cable 105 according to an embodiment of the present invention. In this embodiment cable 105 is a sheathed cable similar to the cables used for gear shifts and brake calipers on bicycles, and is connected operably to both the base drum foot pedal and to the high-hat speed clutch, with both the speed clutch and the base drum foot pedal configured to connect to and operate with the cable. In this embodiment, when a drummer switches to double base, moving the foot used for the high-hat to the second base drum foot pedal (which was not being used), the cable operates the altered speed clutch allowing the upper cymbal of the high-hat to drop to the lower cymbal, as happens with a stick stroke in the prior art.

Figure 2B:
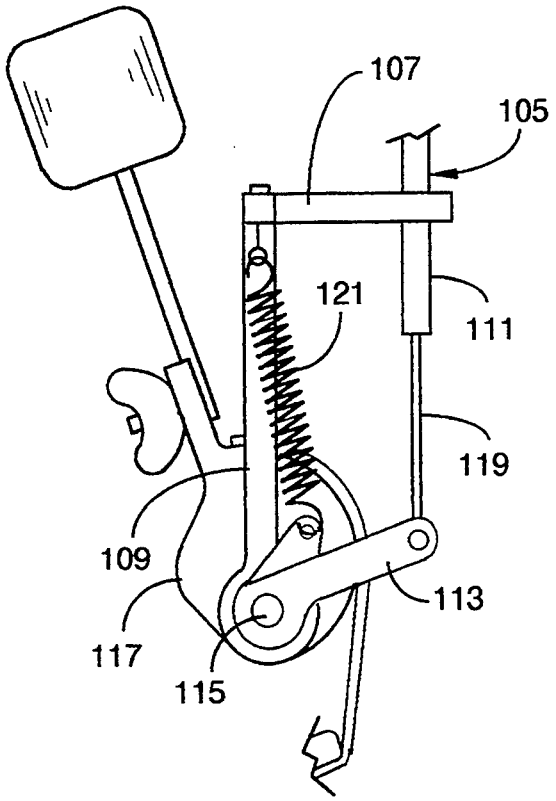
FIG. 2B is an enlarged view of area 2B of FIG. 2A showing additional detail of the connection of the operating cable to the base drum foot pedal unit.
Figure 2C:
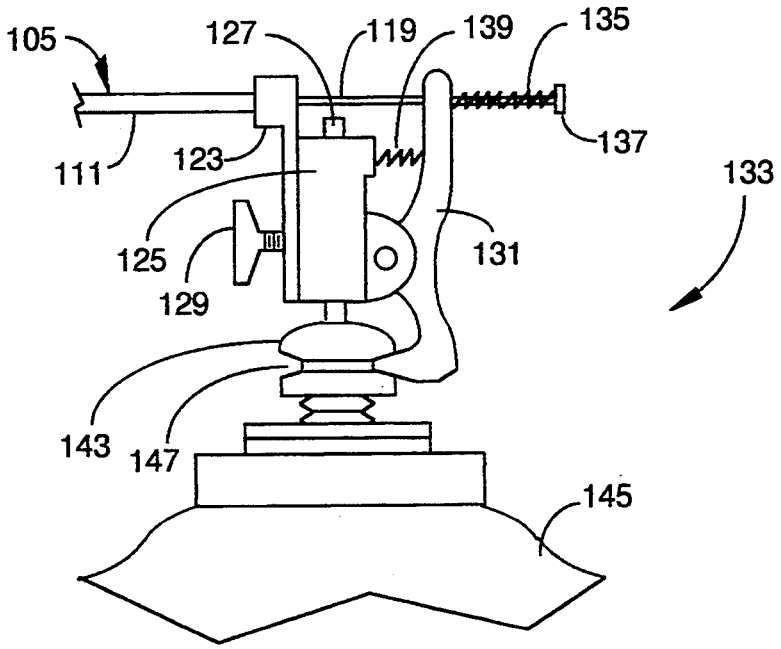
FIG. 2C is an enlarged view of area 2C of FIG. 2A showing additional detail of the operating cable connection to the speed clutch, and additional detail of the speed clutch according to the embodiment of the invention shown in FIG. 2A.

FIG. 2B is an enlargement of area 2B shown in FIG. 2A, and FIG. 2C is an enlargement of area 2C shown in FIG. 2A. Referring to FIG. 2B, an extension 107 is added to spring extension 109 to provide a support for holding cable sheath 111 of operating cable 105. An operating arm 113 is added to shaft 115, which is the shaft that pivots with actuator drum 117. When a drummer operates the base drum foot pedal, shaft 115 rotates, causing arm 113 to rotate and pull internal cable 119 of operating cable 105. When the drummer releases the foot pedal spring 121 rotates shaft 115 opposite to the direction it rotates when the foot pedal is operated, and arm 113 pushes internal cable 119 into sheath 111 of operating cable 105.

Referring to FIG. 2C, an extension 123 is added to clamp element 125, held to shaft 127 by set screw 129. Extension 123 is configured to hold the end of sheath 111 opposite the end at the base drum foot pedal shown in FIG. 2B. Internal cable 119 extends through a hole in lever 131 of remotely-operable high-hat speed clutch 133, through a compression spring 135, and ends at a cap 137.

When the drummer depresses base drum foot pedal 101 (FIG. 2A), internal cable 119 is withdrawn into sheath 111 (FIG. 2C), compressing spring 135, then spring 139, causing lever 131 to disengage from cam cylinder 143, allowing cymbal 145 to drop to rest on a lower cymbal (not shown), as happens in the conventional case with a stick stroke. Spring 135 allows extra freedom so the operating cable does not unduly restrict the operation of the base drum foot pedal.

When the drummer returns to the high-hat foot pedal, a full depression will pull shaft 127 downward carrying clamping element 125 along, causing lever 131 to ride over cam cylinder 123 and to engage in groove 147. When the drummer releases the foot pedal the first time, shaft 127 raises again, and upper cymbal 145 is lifted. The high-hat apparatus then operates in the conventional manner until the drummer again goes to the double base.

In the embodiment of the present invention described above, conventional apparatus may be altered to accommodate the cable operating and retention mechanisms, or new units may be supplied with the necessary connections. In the case of newly designed units, the extension of the speed clutch lever that is conventionally struck with a stick need not be implemented as shown, because there is no more need for the conventional striking operation. There are a number of different ways to accomplish the release of the lever with the operating cable to allow the lower assembly to drop. It is still preferable, however, that the operating lever bear on a cam after release, as shown above, so downward force is applied to the lower assembly, urging the two cymbals of the set together.

Figure 3A:
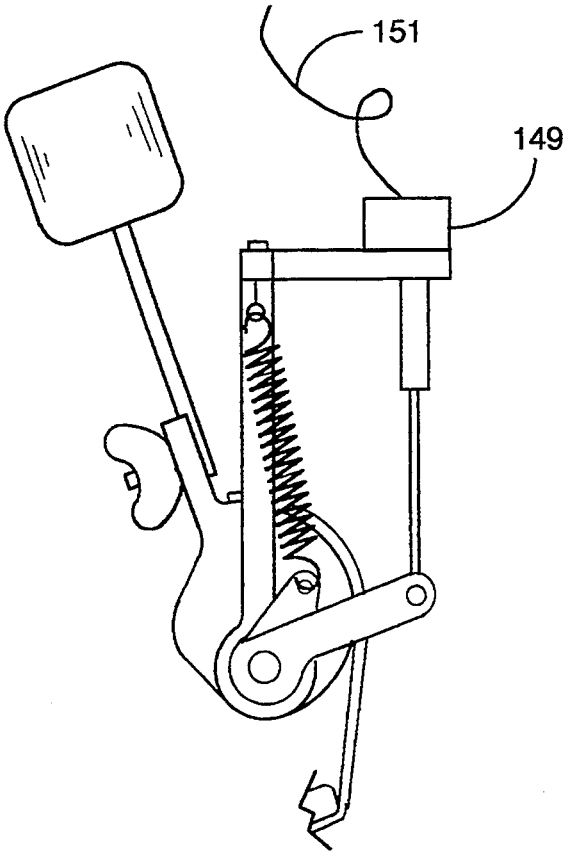
FIG. 3A is a view of an electrical switch mounted on a base drum foot pedal unit in another embodiment of the present invention.
Figure 3B:
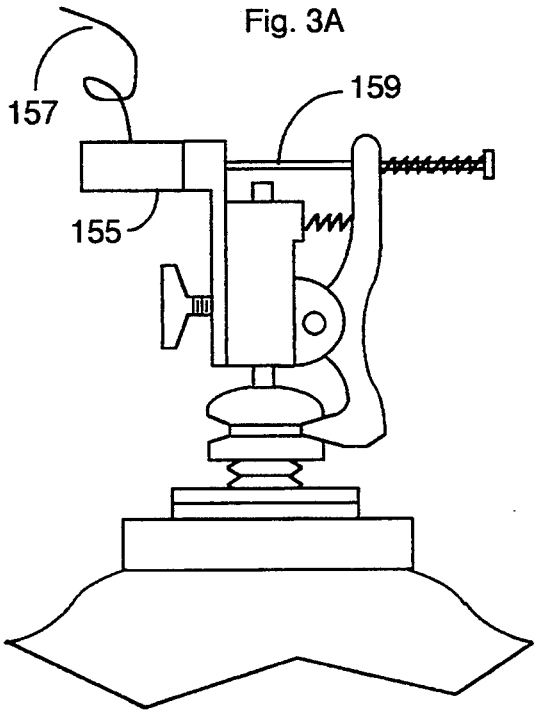
FIG. 3B is a view of a speed clutch with a solenoid operating mechanism according to an embodiment of the present invention.

It will be apparent to one with skill in the art that there are also essentially equivalent ways to accomplish the invention. One such alternative embodiment is shown in FIGS. 3A and 3B. In this alternative embodiment an electrical switch 149 is closed each time the base drum foot pedal is operated, sending an electrical signal on line 151. It will be apparent to one with skill in the art that there are several other ways a switch might be arranged in conjunction with the base drum foot pedal to send the appropriate electrical signal when the foot pedal is operated. In addition, a switch operable by the drummer may be placed at other places than the base drum foot pedal for releasing the remotely-operable speed clutch, so the drummer may release the speed clutch by some other motion than the base drum foot pedal if desired, such as a movement of an elbow or knee.

In this alternative embodiment the high-hat remotely-operable speed clutch according to the invention as shown in FIG. 3B has a solenoid 155 powered and signalled via a sheath of lines 157, one of which is the signal line 151 in FIG. 3A. Each time the drummer operates the base drum foot pedal, solenoid 155 operates retracting shaft 159 releasing the speed clutch.

It will be apparent to others with skill in the art that there are many more alterations that might be made in the embodiments described without departing from the spirit and scope of the invention.

What is claimed is:

1. A remotely-operable high-hat speed clutch for use with a high-hat cymbal apparatus having a vertically-movable central shaft operated by a foot pedal, the speed clutch comprising:

a clamping element adjustably, mountable on said vertically-movable central shaft for supporting said speed clutch on said central shaft;

an upper cymbal carrier assembly slidably engaging said vertically-movable central shaft for carrying an upper cymbal of a two-cymbal set of said high-hat cymbal apparatus;

a coupling means attached to one of said clamping element and said upper cymbal carrier assembly and engaging the other of said clamping element and said upper cymbal carrier assembly such that while engaged both are constrained to move with said central shaft; and a remotely-operable coupling disengagement means connected to said coupling means and having an operating element capable of being positioned remote from said coupling means for disengaging said coupling means and allowing said upper cymbal carrier assembly to slide on said vertically-movable central shaft.

2. A remotely-operable high-hat speed clutch as in claim 1 wherein said coupling means comprises a lever pivotally mounted on said clamping element and engaging an indenture in said upper cymbal carrier assembly, and said remotely operable coupling disengagement means is configured for rotating said lever to disengage said lever from said indenture.

3. A remotely-operable high-hat speed clutch as in claim 2 wherein said remotely-operable coupling disengagement means comprises an inner cable having a sheath, the sheath attached to said clamping element and the inner cable attached to and configured to rotate said lever to disengage from said indenture on said upper cymbal carrier assembly.

4. A remotely-operable high-hat speed clutch as in claim 2 wherein said remotely-operable coupling disengagement means comprises an electrical solenoid attached to said clamping element with a retracting shaft attached to and configured to rotate said lever to disengage from said indenture on said upper cymbal carrier assembly.

5. A high-hat cymbal unit comprising:

a floor-supported frame unit;

a lower cymbal facing upward mounted on said floor-supported frame unit:

a vertically-movable central shaft operable by a high-hat foot pedal;

a clamping element adjustably mountable on said vertically-movable central shaft;

an upper cymbal carrier assembly slidably engaging said vertically-movable central shaft below said clamping element and canning an upper cymbal facing downward;

a coupling means attached to one of said clamping element and said upper cymbal carrier assembly and engaging the other of said clamping element and said upper cymbal carrier assembly such that while engaged both are constrained to move with said central shaft; and a remotely-operable coupling disengagement means connected to said coupling means and having an operating element capable of being positioned remote from said coupling means for disengaging said coupling means and allowing said upper cymbal carrier assembly to slide on said vertically-movable central shaft.

6. A high-hat cymbal unit as in claim 5 wherein said coupling means comprises a lever pivotally mounted on said clamping element and engaging an indenture in said upper cymbal carrier assembly, and said remotely operable coupling disengagement means is configured for rotating said lever to disengage said lever from said indenture.

7. A high hat cymbal unit as in claim 6 wherein said remotely-operable coupling disengagement means comprises an inner cable having a sheath, the sheath attached to said clamping element and the inner cable attached to and configured to rotate said lever to disengage from said indenture on said upper cymbal carrier assembly.

8. A high-hat cymbal unit as in claim 6 wherein said remotely-operable coupling disengagement means comprises an electrical solenoid attached to said clamping element with a retracting shaft attached to and configured to rotate said lever to disengage from said indenture on said upper cymbal carrier assembly.

9. A high-hat cymbal unit and base drum foot pedal assembly comprising:

a remotely-operable speed clutch for carrying and releasing an upper cymbal of said high-hat cymbal unit to fall into contact with a lower cymbal;

operating means connected to said speed clutch for operating said speed-clutch to release said upper cymbal to fall into contact with said lower cymbal; and initiation means mounted on said base drum foot pedal for initiating operation of said operating means.

10. A high-hat cymbal unit and base drum foot pedal assembly as in claim 9 wherein said operating means comprises one end of an operating cable attached to said remotely-operable speed clutch, and said initiation means comprises the other end of the operating cable attached to an element movable with operation of said base drum foot pedal.

11. A high-hat cymbal unit and base drum foot pedal assembly as in claim 9 wherein said operating means comprises a solenoid assembly connected to said speed clutch for operating said speed clutch, and said initiation means comprises an electrical switch mounted on said base drum foot pedal for signalling said solenoid assembly to operate.

* * * * *